US008234727B2

(12) United States Patent
Schreiber et al.

(10) Patent No.: US 8,234,727 B2
(45) Date of Patent: Aug. 7, 2012

(54) PATIENT TRANSFER DEVICE

(75) Inventors: Austin Schreiber, Kalamazoo, MI (US); Kevin Patmore, Plainwell, MI (US)

(73) Assignee: Stryker Corporation, Kalamazoo, MI (US)

( * ) Notice: Subject to any disclaimer, the term of this patent is extended or adjusted under 35 U.S.C. 154(b) by 320 days.

(21) Appl. No.: 12/554,431

(22) Filed: Sep. 4, 2009

(65) Prior Publication Data

US 2011/0056017 A1 Mar. 10, 2011

(51) Int. Cl.
*A61G 7/14* (2006.01)

(52) U.S. Cl. ..... 5/81.1 HS; 5/703; 5/713

(58) Field of Classification Search ..... 5/81.1 HS, 5/703, 709, 713, 715; 180/124, 125
See application file for complete search history.

(56) References Cited

U.S. PATENT DOCUMENTS

| | | | | |
|---|---|---|---|---|
| 3,760,899 | A * | 9/1973 | Crossman et al. | 180/125 |
| 4,483,030 | A | 11/1984 | Flick et al. | |
| 4,528,704 | A | 7/1985 | Wegener et al. | |
| 4,686,719 | A | 8/1987 | Johnson et al. | |
| 5,005,232 | A | 4/1991 | Wright et al. | |
| 5,065,464 | A | 11/1991 | Blanchard et al. | |
| 5,067,189 | A | 11/1991 | Weedling et al. | |
| 5,483,709 | A | 1/1996 | Foster et al. | |
| RE35,299 | E | 7/1996 | Weedling et al. | |
| 5,561,873 | A | 10/1996 | Weedling | |
| 6,073,291 | A | 6/2000 | Davis | |
| 6,467,106 | B1 | 10/2002 | Heimbrock | |
| 6,618,884 | B1 | 9/2003 | Wu | |
| 6,701,544 | B2 | 3/2004 | Heimbrock | |
| 6,820,292 | B2 | 11/2004 | Heimbrock | |
| 6,898,809 | B2 | 5/2005 | Davis | |
| 7,028,350 | B1 | 4/2006 | Davis | |
| 7,032,261 | B2 | 4/2006 | Heimbrock | |
| 7,107,641 | B2 | 9/2006 | Davis | |
| 7,146,660 | B2 * | 12/2006 | Heimbrock | 5/81.1 R |
| 7,168,115 | B2 | 1/2007 | Davis | |
| 7,266,852 | B2 | 9/2007 | Davis | |

(Continued)

FOREIGN PATENT DOCUMENTS

JP 10-179642 7/1998

OTHER PUBLICATIONS

PCT Search Report for corresponding PCT Application No. PCT/US2010/045740 dated Apr. 29, 2011.

*Primary Examiner* — Michael Trettel
(74) *Attorney, Agent, or Firm* — Warner Norcross & Judd LLP

(57) ABSTRACT

A patient transfer device includes a mat, with an upper side and a gas permeable lower side. The mat includes a chamber between its upper and lower sides, which is operable to be in fluid communication with an air source such that when air flows into the mat, the air will flow into the chamber and through the gas permeable lower side to form an air film between the mat and a surface on which the mat is supported at its lower side. In addition, the lower side of the mat is substantially planar when the mat is inflated. A system for controlling the inflation of the mat may be used that automatically adjusts for the inflation of the mat during patient transfer.

21 Claims, 5 Drawing Sheets

U.S. PATENT DOCUMENTS

| | | | | |
|---|---|---|---|---|
| 7,373,680 | B2 | 5/2008 | Davis | |
| 7,376,995 | B2 | 5/2008 | Davis | |
| 7,406,723 | B2 | 8/2008 | Davis | |
| 7,565,709 | B2 | 7/2009 | Davis | |
| 7,574,761 | B2 | 8/2009 | Davis | |
| 7,735,164 | B1 * | 6/2010 | Patrick | 5/81.1 HS |
| 2002/0162172 | A1 | 11/2002 | Federowicz | |
| 2002/0166168 | A1 | 11/2002 | Weedling et al. | |
| 2005/0028273 | A1 | 2/2005 | Weedling et al. | |
| 2005/0034229 | A1 | 2/2005 | Weedling et al. | |
| 2005/0034230 | A1 | 2/2005 | Weedling et al. | |
| 2006/0162086 | A1 | 7/2006 | Davis | |
| 2006/0213010 | A1 | 9/2006 | Davis | |
| 2007/0000048 | A1 | 1/2007 | Davis | |
| 2008/0104762 | A1 | 5/2008 | Davis | |
| 2008/0289102 | A1 | 11/2008 | Davis | |

* cited by examiner

PATIENT TRANSFER DEVICE

BACKGROUND AND TECHNICAL FIELD OF THE INVENTION

The present invention pertains to devices for moving patients and, more particularly, to devices that use air to transfer a patient.

Non-ambulatory patients in a patient facility, such as a hospital or a nursing home, present substantial challenges when such patients must be moved from one location to another. A patient may, for example, need to be moved from a hospital bed to a stretcher and then from the stretcher to a treatment location, such as a surgical table in an operating room. Following treatment, the reverse patient handling sequence may occur; i.e.: the patient is moved from the surgical table, which remains in the operating room, to a stretcher which travels to the patient's hospital room, and then from the stretcher back onto the bed in the hospital room.

In some situations it is preferable that a patient be handled in a manner that minimizes handling or jostling of the patient, for example, in the case of a patient being returned to a hospital room following surgery. The same challenge of moving a patient with minimum handling exists in non-surgical settings as well. The bariatric patient is a prime and very common example. When such a patient is obese, transfers present difficulties for both the patient and the care facility staff. While obese patients represent an extreme end of the spectrum, it should be understood that making any transfer, lateral or otherwise, of any patient or adjustment to a patient's position can induce stress and/or strain and potential injury to a caregiver.

A drawback to some current patient handling procedures, such as sliding the patient across the patient support surface, is that, even with the best intentioned and caring of staff, the patient very often suffers substantial discomfort. The simple act of sliding a patient over a flat surface can be very painful to a patient who has had surgical incisions that are not yet healed, for example, or for patients who have skin lesions or ulcers.

An attempt has been made to overcome the above described problems by the use of an air mattress or pallet onto which the patient is placed while in bed and which is then placed onto a stretcher. A problem common to most of such devices, however, is that invariably the air mattress has the general characteristic of a balloon in the sense that when one area is indented another remote area will bulge. Further, they tend to provide little lateral stability. If, for example, a stretcher carrying an obese person makes a sharp turn during a trip to or from a treatment location, such an obese person may tend to roll or shift laterally toward the edge of the mattress, which could result in a patient rolling off the mattress.

Further, these mattresses require a large volume of air and flow rate to keep them inflated and operational. They also take time to fill and to become operational given their large volumes. Hence, to speed up the process the blowers that inflate the mattresses tend to be large and produce a lot of noise and also another undesirable by-product—heat. If the air into the mattress is too warm, the patient can become uncomfortable. These air pallets also tend to be bulky and may create a cleaning challenge because if body fluids (liquids) are released and flow under the mattress the holes in the bottom of the mattress will allow the liquid to flow into the mattress—likely requiring the disposal of the mattress.

Therefore there is a need for a new patient transfer device that facilitates the movement of a patient with minimal jostling of the patient and also that provides enhanced infection control. Further, a more compact transfer device is desirable that does not require the same volume of air or flow rate associated with prior art air bearing pallets, thus reducing the undesirable by-products of heat and noise that is associated with prior art air bearing pallets.

SUMMARY OF THE INVENTION

Accordingly, the present invention provides a transfer mat that is adapted to transfer a patient using an air film and configured so that it can be operated at a significantly lower air flows than associated with prior art air bearing pallets. The mat also may be configured to provide enhanced infection control.

In one form of the invention, a patient transfer mat includes upper and lower sides and a chamber between its upper and lower sides, which is operable to be in fluid communication with an air source such that when air flows into the mat, the air will flow into the chamber and through a gas permeable portion of the lower side of the mat to form an air film between the mat and a surface on which the mat is supported at its lower side. The mat is configured so that the lower side of the mat remains substantially flat or planar even when the mat is inflated.

In another form of the invention, a patient transfer mat includes a chamber between its upper and lower sides, which is operable to be in fluid communication with an air source such that when air flows into the mat, the air will flow into the chamber and through a gas permeable portion of the lower side of the mat to form an air film between the mat and a surface on which the mat is supported at its lower side. The mat is configured so that the thickness of the mat remains substantially uniform across its width and length even when inflated.

In yet another form of the invention, a patient transfer mat includes a chamber between its upper and lower sides, which is operable to be in fluid communication with an air source such that when air flows into the mat, the air will flow into the chamber and through a gas permeable portion at the lower side of the mat to form an air film between the mat and a surface on which the mat is supported at its lower side. The mat is configured so that the maximum thickness of the mat remains less than 1", optionally less than ½", and optionally about ¼" when inflated.

According to yet another form of the invention, a patient transfer mat includes a chamber between its upper and lower sides, which is operable to be in fluid communication with an air source such that when air flows into the mat, the air will flow into the chamber and through a gas permeable portion of the lower side of the mat to form an air film between the mat and a surface on which the mat is supported at its lower side. The mat is configured so that when a patient is lying on the mat and the mat is inflated, the upper surface will be raised less than 3", optionally less than 2", and optionally less than 1" off the surface supporting the mat to thereby better stabilize a patient over the prior art devices. Further, in some embodiments, the mat may be configured so that when inflated the upper surface raises less than 1", optionally less than ½", and optionally less than ¼" off the support surface.

In yet another form of the invention, a patient transfer mat includes a chamber between its upper and lower sides, which is operable to be in fluid communication with an air source such that when air flows into the mat, the air will flow into the chamber and through a gas permeable portion of the lower side of the mat to form an air film between the mat and a surface on which the mat is supported at its lower side. The mat's upper and lower sides are joined to an intermediate layer that provides a substantially continuous connection between the upper and lower sides so that when air flows into the chamber the upper and lower sides remain substantially flat and uniformly spaced. In this manner, the mat will not tend to billow, taco or hot dog—and instead, will retain its generally flat shape when inflated.

According to another form, of the invention, a patient transfer mat includes a chamber between its upper impermeable side and lower gas permeable side with a volume of less than 1 cubic foot, which is operable to be in fluid communication with an air source such that when air flows into the mat, the air will flow into the chamber and through the lower gas permeable side of the mat to form an air film between the mat and a surface on which the mat is supported at its lower side.

In any of the above mats, the mat is configured to generate an air film sufficient to move a patient supported on the mat with a flow rate into the chamber in a range of 7-10 cubic feet per minute.

In any of the above mats, the mat includes an impermeable upper side formed by a gas and liquid impermeable barrier so that air in the chamber will not be directed from the upper side of the mat. Similarly the lower side may be formed by a gas permeable barrier and optionally a gas permeable but generally liquid impermeable barrier so that gas can flow from the lower side of the mat but liquid cannot flow into the mat unless it is sufficiently pressurized. For example, the lower side may be adapted to limit liquid with pressures less than 50 psi from flowing into the chamber.

Also in any of the above mats, the mat may include an intermediate layer formed from gas permeable material, such as an open-cell foam or spacer fabric, including a 3D fabric.

In a further aspect, the impermeable barrier may be formed by an impermeable material coated on or bonded to the upper side of the intermediate layer to thereby form a gas and liquid impermeable barrier at the upper side of the intermediate layer. Similarly, the lower layer may be formed on the lower side of the intermediate layer by a gas permeable, but generally liquid impermeable material, which may be coated on or bonded to the intermediate layer at the lower side thereof to thereby form a gas permeable, generally liquid impermeable barrier at the lower side. Alternately, the lower layer may be formed from a permeable material.

Further, in any of the above mats, the mat itself may be formed from a drop-stitch fabric, for example, a Sevytex® fabric, which forms the upper and lower sides of the mat and when deflated assumes a flat compact configuration but when inflated increases the separation between the upper and lower sides but only up to a separation where the mat has thickness less than 1", optionally less than ½", or a thickness of about ¼".

In another form of the invention, a patient transfer device includes a mat with a liquid and gas permeable compressible intermediate layer having an upper side and a lower side, which is permeable both laterally and longitudinally through the layer and orthogonally to the layer. The upper layer or side of the mat is impermeable to gas and liquids, and the lower side or layer of the mat is gas permeable, but limits liquid with pressures less than 50 psi from flowing into the mat. The mat includes a chamber formed around the intermediate layer, which is operable to be in fluid communication with an air source such that when air flows into the chamber, the air will flow through the intermediate layer and further from the gas permeable lower side to form an air film between the mat and a surface on which the mat is supported at its lower side.

In one aspect, the upper layer is formed on the upper side of the intermediate layer. For example, an impermeable material may be coated on or bonded to the upper side of the intermediate layer to thereby form a gas and liquid impermeable barrier at the upper side of the intermediate layer. Similarly, the lower layer may be formed on the lower side of the intermediate layer by a gas permeable, but generally liquid impermeable material, which may be coated on or bonded to the intermediate layer at the lower side thereof to thereby form a gas permeable, generally liquid impermeable barrier at the lower side.

In any of the above forms of the invention, the mat may be provided with an inlet, for example, at the lower side, upper side, or at the edge of the mat, which is adapted to couple to an air source.

In accordance with yet another form of the invention, a patient transfer mat includes a liquid and gas permeable compressible intermediate layer having an upper side and a lower side, a liquid and gas impermeable barrier at the upper side of the intermediate layer for facing a patient, and a generally liquid impermeable, gas permeable barrier at the lower side for facing a support surface. The liquid and gas impermeable barrier and the generally liquid impermeable, gas permeable barrier enclose the intermediate layer to thereby form a chamber about the intermediate layer. Further, the barriers are bonded to or otherwise formed at the respective upper and lower sides of the intermediate layer. The mat further includes an inlet that is operable to be in fluid communication with the chamber and is adapted for connection to an air source such that when air flows into the mat, the air will flow into the chamber and through the intermediate layer and through the generally liquid impermeable, gas permeable barrier to form an air film between the mat and a surface on which the mat is supported at its lower side.

In any of the above, the liquid and gas impermeable barriers may be formed by a liquid and gas impermeable sheet. For example, the sheet may comprise a polymer sheet or a woven sheet with an impermeable coating, such a vinyl.

Similarly, the generally liquid impermeable, gas permeable barriers may be formed by a generally liquid impermeable, gas permeable sheet. For example, the liquid impermeable, gas permeable sheet may be formed from a non-woven sheet with a plurality of perforations that are sized to permit gas to flow through sheet but to limit the flow of a liquid therethrough. For example, the perforations may be provided in arrays across the liquid impermeable, gas permeable sheet such that they cover essentially the entire bottom surface of the mat.

Alternately, the generally liquid impermeable, gas permeable sheet may comprise a woven sheet with a weave that forms a plurality of interstices, with the interstices sized to permit gas to flow through the sheet but to prevent the flow of a liquid therethrough.

In yet a further aspect, the generally liquid impermeable, gas permeable sheet may comprise a woven sheet with a coating, which is perforated to form a plurality of perforations that are sized to permit gas to flow through the sheet but to prevent the flow of a liquid therethrough.

In addition, each of the sheets may be bonded to the respective side of the intermediate layer. For example, the sheets may be bonded to the intermediate layer by an adhesive bond, including a bond formed by an intermediate adhesive layer (such as a sprayed on or brushed on coating of adhesive, a film of adhesive, or a fabric impregnated with adhesive), or a chemical bond (based on their chemical composition), or heat bond (e.g. welds). Further, the sheets are bonded to the intermediate layer with a substantially continuous bond (generally only interrupted by the interstices in the material forming the intermediate layer) so that together they form a substantially monolithic body and consequently form a plurality of ties or tethers between the upper side and the lower side of the mat with the material forming the intermediate layer. In this manner, the mat will not tend to billow, taco or hot dog—and instead, will retain its generally flat shape and the range of variability in the top and bottom topography is minimal.

In further aspects, the generally liquid impermeable, gas permeable sheets may include a plurality of perforations, which are sized to permit gas to flow through the generally liquid impermeable, gas permeable sheets but to limit the flow of a liquid therethrough. For example, the perforations may be sized to limit liquids from passing through that have a pressure of under 50 psi. For example, the perforations may be provided in arrays across the liquid impermeable, gas permeable sheets such they cover essentially the entire bottom surface of the mats. Consequently, when a portion of the mat aligned over a gap or discontinuity there will still be sufficient air film under the remainder of the mat to facilitate the transfer.

In another aspect, the barriers are formed by a coating, such as a sprayed on coating. In the case of the generally liquid impermeable, gas permeable barrier, an impermeable coating may be applied and then perforations are formed, which are sized to permit gas to flow through sheet but to limit the flow of a liquid therethrough if the liquid has a pressure of under 50 psi.

According to yet other aspects, the intermediate layers of any of the above mats may comprise an open cell foam, such as an open cell polyurethane foam. Alternately, or in addition the intermediate layers may comprise a three-dimensional (3D) knit fabric. In addition, the intermediate layers may be formed from a drop-stitch fabric, such as a Sevytex® fabric. Optionally, the intermediate layers have uniform thicknesses; though the intermediate layers may have varying thicknesses. For example, the thickness at the edges of the intermediate layer may be thicker to form a cradle for the patient.

In yet other aspects, the mats may incorporate structures to facilitate handling, such as straps, handholds or the like. For example, straps may be mounted to the top or bottom sides of the mats or may be secured to the mats between the sheets forming the barriers.

Alternately, the mats may incorporate one or more flanges that extend from a lateral side or sides of the mats. The flange or flanges then may provide a mounting surface for a strap or straps or handholds. Alternately, the flanges may be configured to form the straps or handholds. The flanges may be flexible and further may be formed from one or both of the sheets forming the barriers. In addition, the flanges may be inflatable to form pontoons, which may be used to cradle a patient.

Alternately, the flanges may be formed from flexible sheets or panels that are secured to one or both of the sheets. For example, when using non-structural barriers, such as when the barriers are formed from coatings rather than sheets, then the flange may be coupled the intermediate layer.

The flanges may extend the full length of the lateral side of the mat or may extend only along a portion of the length of the mat. Further, multiple flanges may be provide at one or more sides. For example, flanges may be provided at the head end of the lateral side of the mat and at the foot end of lateral side of the mat. Further, flanges may be provided at the foot end or head end of the mat or both to facilitate handling of the mat and the patient supported thereon. Further, the flanges may be tucked under a mattress to secure the mat to the mattress.

In addition, the flanges may be formed as semi-flexible flanges to form guide surfaces for the mat. For example, when sliding the mat between two surfaces where the surface from which the mat is being transferred is lower, the flanges may be used to guide and lift the edge of the mat upwardly as it makes contact with the adjacent surface.

Accordingly, the present invention provides a patient transfer mat may be more compact than conventional patient air pallets, and further require less air flow to remain operational. Further, the mat can be configured to provide enhanced infection control. In addition, the mat may generate an air film which facilitates the transfer of a patient but which is not lost or compromised when a portion of the mat is aligned over a gap or discontinuity.

In accordance with still other aspects of the invention, a system and method for automatically controlling the air flow to the mat is provided. The system and method include a blower or air pump that inflates the inflatable mat and which is controlled by a controller that automatically adjusts the speed of the blower to compensate for air losses in the air mat. The automatic adjustment of the blower enables the motor of the blower to operate at reduced power levels when little air flow is needed and to automatically increase its power levels when conditions warrant. This helps reduce wear and tear on the blower, reduces the noise level of the blower, conserves energy, and helps to lower the temperature of the air inside the inflatable mat, which may otherwise reach uncomfortable levels for the patient being transferred.

In one aspect, a patient lateral transfer system is provided that includes an inflatable mat, a blower with a motor, a hose, at least one sensor, and a motor controller. The inflatable mat includes a top surface and a bottom surface wherein the top surface supports a patient and the bottom surface includes a plurality of perforations that allow air to escape in a manner that creates an air bearing underneath the inflatable mat. The hose connects to the blower and the inflatable mat such that the blower can deliver pressurized air to the inflatable mat when the hose is connected therebetween. The sensor detects at least one of air pressure in the inflatable mat and a flow rate of air being blown from the blower to the inflatable mat, and the sensor outputs a signal relating to at least one of the air pressure and flow rate. The motor controller controls the motor based at least partially upon the signal from the sensor.

According to another aspect, a method for controlling a motor of a blower that is adapted to inflate an inflatable mat is provided. The mat includes a top surface and a bottom surface wherein the bottom surface includes a plurality of perforations adapted to generate an air cushion when the inflatable mat is inflated. The method includes operating a motor within the blower at a first speed during an initial inflation of the inflatable mat; decreasing a speed of the motor subsequent to the inflation of the inflatable mat; and increasing a speed of the motor in order to compensate for air loss from the inflatable mat as the mat is moved from a first surface to a second, spaced apart surface.

According to yet another aspect, a method for laterally transferring a patient from a first support surface to a second support surface is provided. The method includes positioning a patient on an inflatable mat on the first support surface wherein the top surface of the mat supports the patient and the bottom surface of the mat includes a plurality of perforations that allow pressurized air contained within the inflatable mat to escape. The method further includes inflating the inflatable mat with a blower having a motor; moving the inflatable mat from the first surface to the second surface; and, during movement of the inflatable mat from the first surface to the second surface, automatically increasing a speed of the blower motor when the amount of air that escapes from the inflatable mat increases and automatically decreasing the speed of the blower motor when the amount of air escaping from the mat decreases.

According to other aspects, the motor controller may be configured to adjust a characteristic of the motor automatically after the inflatable mat is fully inflated, such as, but not limited to, a flow rate, a speed, or a pressure generated by the motor within the mat. The motor controller may also be configured to automatically determine when the mat is fully inflated by monitoring an output of the flow rate sensor. The motor controller may also vary a speed or power of the motor in response to pressure changes wherein the varying includes increasing the speed or power of the motor when substantial losses of air from the inflatable mat occur during lateral transport of the mat, and decreasing the speed or power of the motor when substantially no losses of air from the mat occur. The motor controller may further be adapted to control the motor based at least partially upon the output from a timer. The methods for controlling the blower motor may also include making adjustments to the speed of the motor based upon either or both of the air pressure and the flow rate. Still further, the methods for controlling the blower motor may further be based at least partially upon the output from a timer.

These and other objects, advantages, purposes, and features of the invention will become more apparent from the study of the following description taken in conjunction with the drawings.

DETAILED DESCRIPTION OF THE PREFERRED EMBODIMENTS

Figure 1:
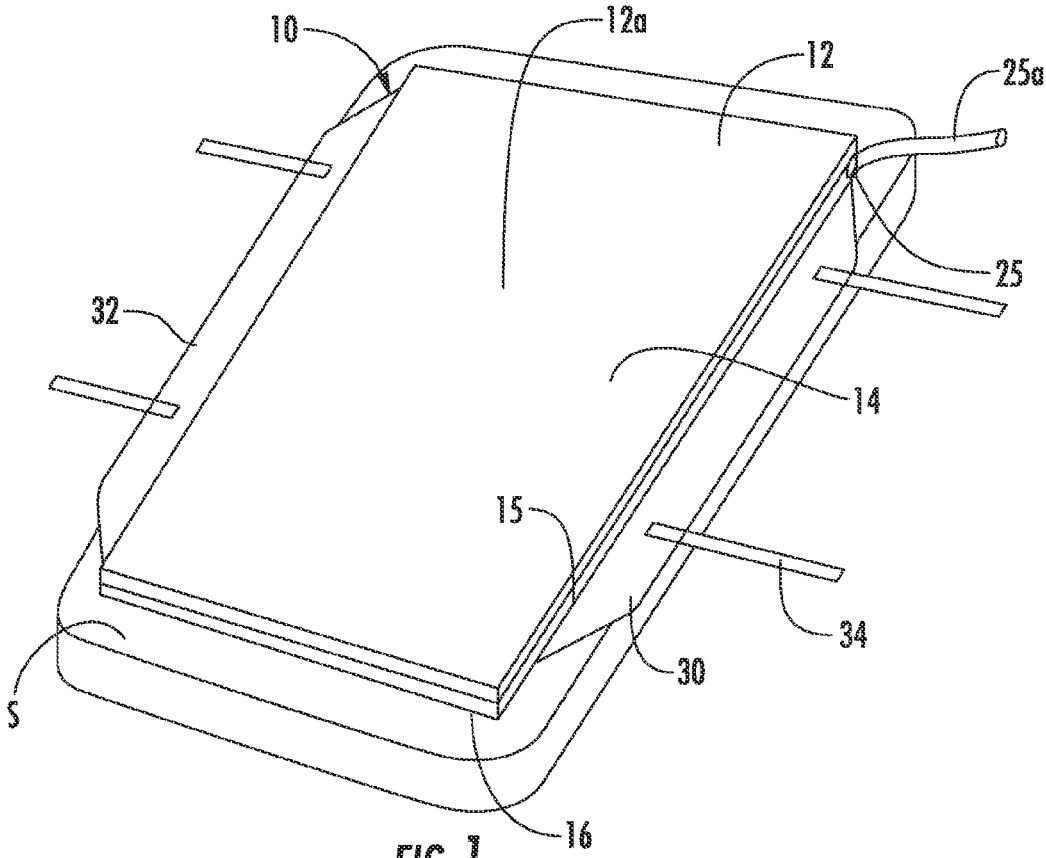
FIG. 1 illustrates a perspective view of a patient transfer device according to one embodiment of the present invention.

Referring to FIG. 1, the numeral 10 generally designate a patient transfer device of the present invention. As will be more fully described below, the patient transfer device comprises an air mat 12 that generates an air film and, optionally, across a significant portion, if not substantially it's entire portion, of its lower surface for transferring a patient across a surface and between surfaces. Although the term "patient" is used herein, it should be understood that patient should be broadly construed to not only include people awaiting or under medical care, but also to include invalids or other people in need of assistance. Further, the mat may be operated with a lower air flow than conventional air bearing pallets while still achieving the same or better ease of transfer than prior art air bearing pallets. Because lower air flow is needed, device 10 may be operated with a smaller blower than used heretofore with the prior art air bearing pallets or with a pump, which saves energy, reduces noise, and generates less heat.

Figure 2:
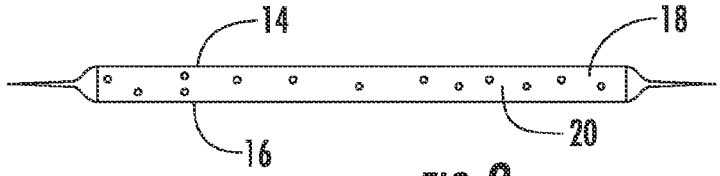
FIG. 2 is a cross-section view taken along line II-II of FIG. 1.
Figure 3:
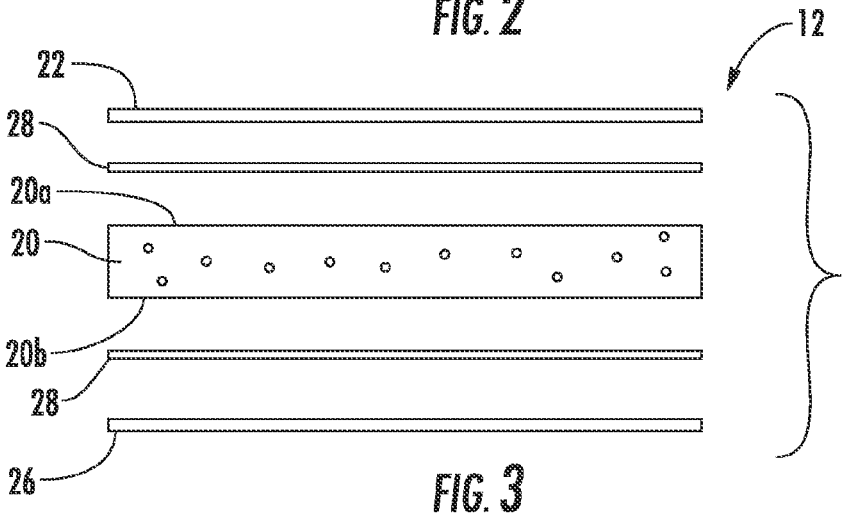
FIG. 3 is an exploded view of a cross-section of the mat.

Referring to FIGS. 2 and 3, mat 12 includes an upper side 14 for supporting a patient thereon and a lower side 16, which is supported on a support surface S such as a bed, stretcher, or the like. Further, mat 12 includes an air chamber 18, which when filled with air generates an air film at lower side 16. As will be more fully described below, upper surface 14 comprises an impermeable barrier, while lower side 16 comprises a gas permeable barrier through which air flows to form the air film when chamber 18 is inflated. Optionally, as will be more fully described below, lower side 16 may also comprise a generally liquid impermeable, gas permeable barrier to allow air to flow from lower side 16 prevent, at least over certain ranges of pressures, liquids from flowing into the mat.

Chamber 18 may be filled with a flexible, liquid and gas permeable layer 20 that is intermediate upper and lower sides 14 and 16 and which is permeable in all directions. In this manner, when air flows into layer 20, the air can move longitudinally, laterally or transversely through layer 20. To inflate chamber 18, mat 12 includes an inlet 22, which may be located at the upper side 14, lower side 16, or at the edge or lateral side of the mat. Inlet 22 is adapted, for example by way of a conduit 24, to couple to an air supply source, such as a blower. When air flows into conduit 24 and mat 12 through inlet 22, the air will flow through the intermediate layer 20 and then exit through the gas permeable lower side 16 to thereby form an air film beneath mat 12.

Referring to FIG. 3, the gas and liquid impermeable side 14 may be formed from a sheet 24, which is bonded to an upper side 20*a* of intermediate layer by adhesive 28. Similarly, generally gas permeable side 16 may also be formed from a gas permeable sheet 26, which is bonded to lower side 20*b* of intermediate layer 20 by adhesive 28, such as a urethane based adhesive. For example, adhesive 28 may be coated, sprayed or otherwise applied to the respective upper and lower sides of the intermediate layer; or adhesive 28 may be provided in the form of a film or a sheet that is embedded with an adhesive, which is then activated for example by heat or other energy sources. Alternately, the sheet may be bonded by a chemical interaction with the intermediate layer.

In this manner the upper and lower sides of the mat are interconnected by a substantially continuous connection so that the upper and lower sides together with the intermediate layer form a monolithic body so that when mat 12 is inflated, the upper and lower sides will retain their spacing and orientation so that they remain substantially uniformly spaced. In other words—when inflated the upper side does not raise relative to the lower side in an appreciable amount and will raise less than 3", less than 2", less than 1", less than ½", or optionally less than ¼ relative to the lower surface and, hence, relative to the surface supporting the mat. As a result, the patient is not raised a significant amount either, thus providing increased stability to the patient. Further, the range of variability in the top and bottom topography of the mat when the mat is inflated will be minimal. For example, the variation in height between the upper and lower sides will be less than ¼", optionally less than ⅛", and may be less than 1/16" variation. For example, in the case of an intermediate layer with uniform thickness, the upper and lower sides will remain substantially parallel, and each side will remain substantially flat.

Liquid and gas impermeable sheet 22 may be formed from an impermeable material, such as a nylon or a plastic, or may be formed from a permeable material, such as a woven sheet of material, which then includes a liquid and gas impermeable coating on one of its surfaces to thereby form an impermeable sheet. Similarly, sheet 26 may be formed from an impermeable sheet but which is then made gas permeable by forming small perforations in the sheet. For example, the size of the perforations may be on the order of thousands of an inch to thereby form a gas permeable, but substantial liquid impermeable sheet. Further, the density of the perforations may fall, for example in a range of 50 to 100 holes per square inch. The size of the openings may range, for example, from about 1/20,000 inch in diameter to about 1/5,000 of inch in diameter for example. In addition, it has been found that for openings having a diameter on the order of about 1/20,000 inch, the number of openings to achieve the desired film is about 1500-2500 and optionally about 2000 for an adult size mat, for example on the order of a 36" by 84" mat. It has been found that for openings having a diameter on the order of about 1/8,000 inch the number of openings to achieve the desired film is about 8,000 to 12,000 and optionally about 10,000 for an adult size mat. Similarly, it has been found that for openings having a diameter on the order of about 1/5,000 inch the number of openings to achieve the desired film is about 30,000 to 34,000 and optionally about 32,000. Thus, depending on the size of the openings, an adult size mat may have any where from 1,500 to 34,000 openings or perforations on its lower side. It also has been found that better performance is achieved when openings or perforations (or interstices) are provided across the full length and width of the lower side of the mat.

Alternately, sheet 26 may be formed from a woven material, which has interstices that are sized so that the weave is gas permeable and further optionally generally liquid impermeable, for example for liquids below 50 psi. For example, suitable generally liquid impermeable, gas permeable materials may include Tyvek or Gortex. Other suitable woven fabrics generally include fabrics formed from polyolefins, urethanes, polypropylenes, and polyethers. Although described in reference to the perforations or interstices covering the full extent of the downwardly facing side of the mat, it should be understood that the mat may be formed with perforations or interstices over only a portion or over portions of the lower side of the mat.

Regardless of the bonding method, to achieve optimal performance, the sheets are bonded to the intermediate layer with a substantially continuous bond so that they form a substantially monolithic body with the intermediate body. Further, they are sealed together about intermediate layer 20 at a perimeter joint or seam 15, to thereby full enclose intermediate layer 20 and thereby form the chamber about layer 20. In this manner, the intermediate layer forms a continuous connection—that is a plurality of closely spaced ties or tethers between the upper side and lower side of the mat, or what is referred to herein a "continuous baffle". With this construction, mat 12 does not exhibit any significant billowing effects, nor does it exhibit any tacking effects. Instead, as noted above with a uniform thickness intermediate layer, the upper and lower sides of the mat remain substantially uniformly spaced and remain generally planar with its lower side 16 lying substantially flat against surface S on which it is supported. In this manner, the air flowing through lower surface 16 can form an air film across substantially the entire side 16 facing support surface S. When combined with the relatively air flow, mat 12 will not experience a significant loss of the air film when the mat is transferred from surface S across a gap to an adjacent surface; hence, mat 12 provides an ease of transfer that is at least as equal to or better than most prior art air bearing pallet designs.

In other forms, the gas and liquid impermeable side 14 may be formed by a liquid and gas impermeable coating applied to the upper side 20*a* of intermediate layer 20. For example, suitable coatings may include urethane coatings. Similarly, the gas permeable, and optionally, generally liquid impermeable side may be formed by a coating applied to lower side 20*b* of intermediate layer 20, which is then perforated. The coatings are then joined at perimeter joint or seam 15, again to thereby form chamber 18 about layer 20.

As noted above, to form the generally liquid impermeable barrier the size of the perforations or the openings formed by the interstices formed in the woven fabric are such that liquids will not flow into the mat but will allow gas to flow from the mat, which provides enhanced contamination control. In addition, with the smaller openings, the flow of air from side 16, while sufficient to form an air film, is sufficiently low to reduce the required pressure and gas flow into mat 12. For example, it has been found that the mat 12 may operate using a 200 watt electric blower as compared to a 1200 watt electric blower currently used on patient air pallet designs.

As noted above, intermediate layer 20 comprises a liquid and gas permeable material. For example, suitable materials include open cell foams, including an open cell urethane or polyurethane foam. Further, a suitable foam has a relatively low density but a high porosity, for example 30 ppi. As noted above, by bonding the upper and lower sheets to the upper and lower surfaces of the intermediate layer or forming the barriers at the upper and lower surfaces of the intermediate layer, namely the foam, the foam will form a substantially continuous connection (e.g. form thousands of ties or tethers spaced at less than 1/16" apart, optionally less than 1/32" apart, and more typically less than 1/64" apart) between the upper and lower side of the mat. Depending on the foam density (or 3D knit fabric noted below), there could be tens of thousands of tethers. However, unlike the prior art air bearing pallet with discrete spaced apart baffles or tethers, the foam will allow lateral and longitudinal flow of air through the intermediate layer, in addition to the transverse flow through the thickness of the intermediate layer. As noted, therefore, the intermediate layer forms a "continuous baffle" between the upper and lower sides of the mat.

Alternately, intermediate layer 20 may comprise a three-dimensional fabric. An example of a suitable three-dimensional fabric is available from Dartex. In a similar manner to the foam, a 3-D material emulates the continuous baffle provided in the previous embodiment.

In another form, the intermediate layer or the mat 12 may be formed form a drop-stitch fabric, for example, a drop-stitch fabric available under the trademark Sevytex®. The drop-stitch fabric has an upper surface and a lower surface which are interconnected by strands or fibers. The upper and lower sides are woven so that the fabric is liquid and gas impermeable. When un-inflated, the strands provide no compression resistance; therefore the mat is relatively flat. When air is flowed into the space between the upper and lower sides, the strands become aligned and oriented generally perpendicular to the upper and lower sides and provide compression resistance and space the upper and lower sides apart. The lower side then is provided with suitable perforations to achieve the desired gas permeability while retaining the liquid impermeability as noted above. Alternately, the drop-stitch fabric may be coated or provided with sheets (adhered to or otherwise laminated to the drop-stitch fabric) as described above.

In any of the above embodiment, the thickness of the mat may be significantly reduced over the prior art air bearing pallets, which typically range from 6 to 10 inches in height when inflated. For example, the thickness of the mat may reduced to a range of 3" to ½" or down to ⅛", depending on the capacity desired for the mat. It has been found that a 2" thick intermediate layer of an open cell polyurethane will adequately transfer a patient of 600 pounds or less. It has also been found that a ¼" thick mat formed from a 3D fabric intermediate layer will adequately transfer a patient of at least 200 pounds.

An exemplary size that can be used for mat 12 is a 36" by 84" mat. For mats of this size with a thickness of 3", this means the volume of the chamber formed by the intermediate layer may be approximately 6 cubic feet. A mat of this size with a thickness of about 2" may have a chamber volume of about 4 cubic feet. Similarly, mats of this size with a thickness of about 1" can have a chamber volume of about 2 cubic feet. It has been found that a 36" by 84" mat with a thickness of about ½" or about ¼" can be operational for transferring a patient with an air flow of about 7-10 cubic feet per minute. With a less than 1 cubic foot volume (e.g. a ½" thick mat may have a chamber volume of about 0.98 cubic feet), optionally less than about a 0.5 cubic foot volume (e.g. ¼" mats would have a chamber volume of approximately 0.49 cubic feet) or about a 0.3 cubic foot volume (e.g. for a ⅛" thick mat), the pressure in the mat with the noted 7-10 cubic feet per minute air flow, and with the gas permeabilities noted above, ranges from about 3 to 4 psi. It should be understood that while several specific examples of the mat thickness have been provided, the thickness may fall between these valves and, further, may exceed these values, though one or more of the attendant benefits of the thinner mats described herein, e.g. stability, reduced volume, etc. may be reduced.

Given the reduction in the volume of the chamber over prior art air transfer mats (which typically run on the order of 18 cubic feet), the outside diameter of the inlet 22 may be reduced over prior art air bearing pallet inlets. For example, it has been found that sufficient air flow can be achieved using, as noted above, a 200 watt blower and, further, with a % inch inlet or tubing at the inlet. Further, in lieu of a blower, a small pump or compressor may be used. For example, a small pump may be used, for example an 80 watt pump.

Consequently, in addition to the reducing size of the mat, which makes stowing much easier than in prior art air bearing pallets, the reduced size of the chamber allows a pump to be used and also a pump that is small enough to be integrated into the surface should a fully contained device be desired. For example, an internal or external pocket may be provided to house such a pump. In addition, the noise and heat generated by the reduced sized blower or the pump is significantly reduced than prior art air pallet blowers. Given the significantly reduced volume of the chamber, the fill time may also be drastically reduced, and the distance a patient is lifted from the surface on which the mat is supported may be also drastically reduced from a conventional air bearing pallet, which lifts a patient in a range of 6-10 inches off the supporting surface, to less than 3", less than 2", less than 1", or optionally less than ½" and as low as about ⅛" off the surface, which increases the stability of the patient.

Referring again to FIG. 1, mat 12 may include one or more flanges 30 and 32. Flanges 30 and 32 may be provided at the opposed lateral sides of mat 12 and may be used as a mounting surface for straps 34 or hand holds, which also may be formed from strap material. The flanges may be formed from the sheets forming the upper and lower layers or may be formed from separate sheets or panels that are attached to the mat. For example, when formed from separate panels or sheets, flanges 30 and 32 may be secured at the joint or seam 15 formed between the upper and lower sheets and, further, may be joined to the intermediate layer, for example by an adhesive, fasteners, or by chemical bonding. Further, flanges 30 may be flexible flanges or may be rigid flanges.

Figure 6:
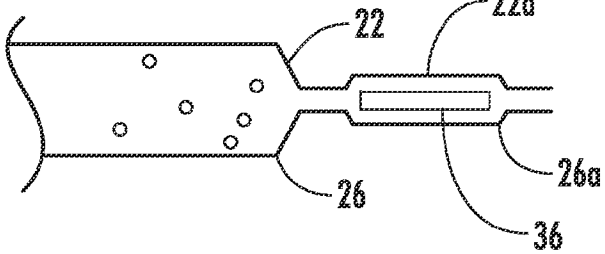
FIG. 6 is an enlarged cross-section of another embodiment of the flange of the mat.

Referring to FIG. 6, where the flanges are formed from the sheets that form the upper and lower sides of the mat, a reinforcement member 36 may be inserted between the extensions or flaps 22*a* and 26*a* of the upper and lower sheets which form the upper and lower sides of mat 12. Extensions 22*a* and 26*a* form the upper and lower sheets of 30*a*, 30*b* of the flanges 30, 32 and may be joined together with a bond, such as an adhesive bond, a chemical bond, or heat-activated bond, with the reinforcement member captured between the joined extensions or flaps.

Figure 4:
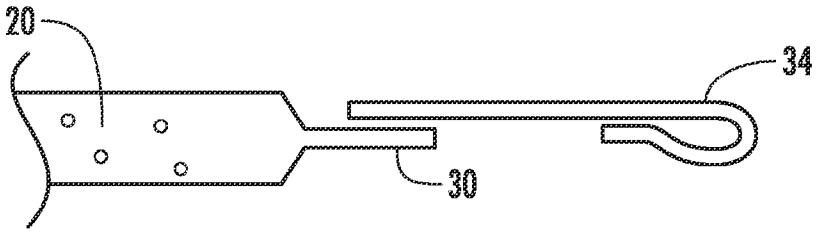
FIG. 4 is an enlarged cross-section of the connection of a tether or strap to the mat.
Figure 5:
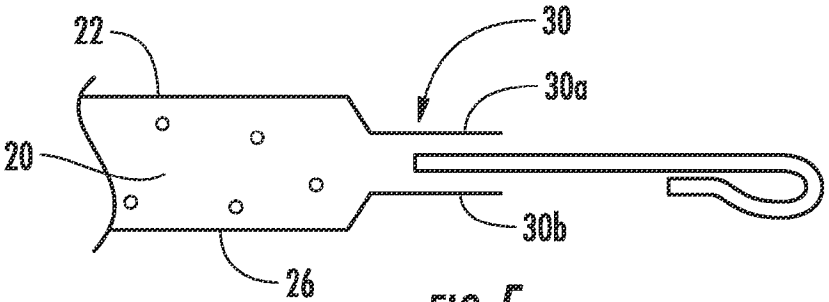
FIG. 5 is an enlarged cross-section of another embodiment of the connection of a tether or strap to the mat.

As noted above, flanges 30 and 32 may provide a mounting surface for straps 34. Referring to FIG. 4, straps 34 may be surface mounted to the flanges 30, 32 or may be sandwiched between the respective upper and lower sheets 30*a*, 30*b* of the flanges 30, 32.

Figure 7:
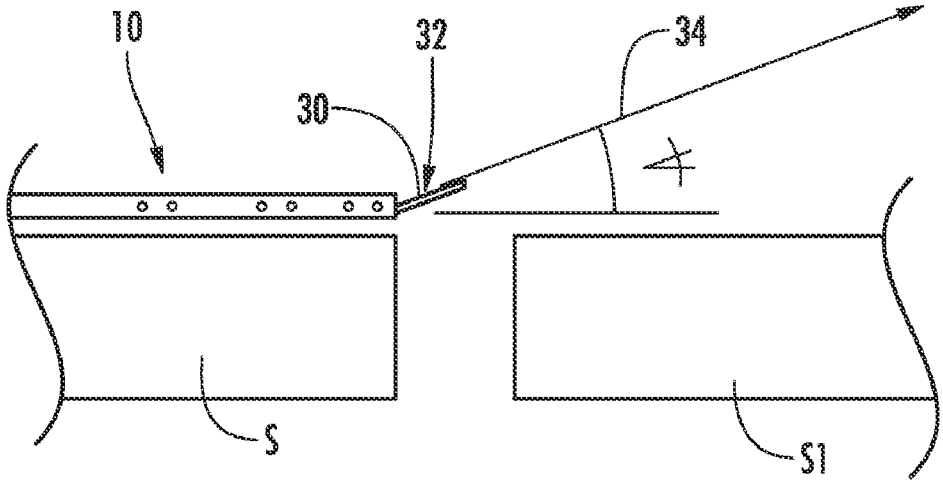
FIGS. 7 and 8 illustrate the use of a flange of the mat as a guide when transferring from a lower surface to a higher surface.
Figure 8:
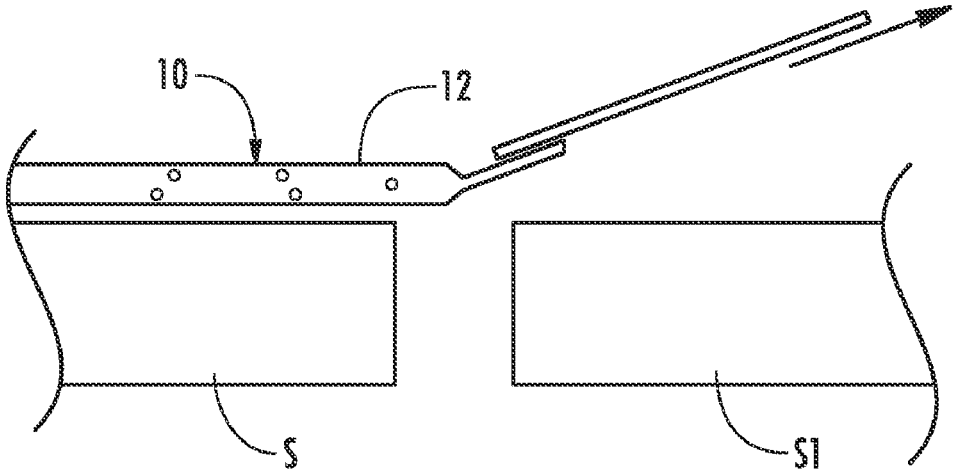

Referring to FIGS. 7 and 8, whether flanges 30 or 32 are flexible or at least partially semi-rigid, flanges 30 and 32 may be used to form a guide surface for mat 12 when, for example mat 12 is transferring from a surface S, which is lower than the adjacent surface S1. As best seen in FIG. 7, when a user pulls on the strap 34, which is secured to a respective flange, the respective flange will tend to lift up and, further, pull on the edge of the mat 12 to thereby lift mat 12 over the edge of the adjacent higher surface.

It should be understood that the size and length of the flanges may be varied. For example, the flanges may be sized so that when the mat is positioned on top of a mattress or other supporting surface, the flanges can be extended under or tucked under the mattress so as to releasably secure the mat to the mattress. Furthermore, multiple flanges may be provided on each side, and also may be provided at the foot and head end of the mat. For example, one flange may be provided at the head end of the lateral side of the mat and another flange may be provided at the foot end of the lateral side of the mat. It should be understood that the shape and thickness of the flange may be varied as desired. Furthermore, the respective flanges may have formed therein transverse openings to form hand holds.

Also, the flanges may be inflated so that when inflated they may form pontoons for the mat; therefore, each flange may include its own inlet. Alternately or in addition, each flange may have a chamber that is in fluid communication with chamber 18 so that when chamber 18 is inflated so too are the flanges.

In the illustrated embodiment, intermediate layer 20 has a generally uniform thickness across its width and length. However, it should be understood that the intermediate layer 20 may have a varying cross-section. For example, the thickness of the lateral portions may be increased in one or more regions to create a cradling effect for the patient that is supported thereon. For example, the lateral side edges of the intermediate layer may include wedge-shaped cross-sections or arcuate-shaped cross-sections. Further, the intermediate layer 20 may have indentations in the intermediate or central portion 12*a* of mat 12 to provide localized depressed areas for the legs, the torso, or just the head. This may provide the patient with an increased feeling of security. Furthermore, this cradling effect may be achieved just through the material properties of the foam or 3-D fabric.

Control System for Air Transfer Device

FIGS. 9-13 illustrate various aspects of a method and system for controlling a patient lateral transfer system 120. The patient lateral transfer system 120 may utilize the mat 12 and transfer device 10, described above, or it may utilize mats of entirely different construction, such as described below and illustrated in FIGS. 9-13.

Figure 9:
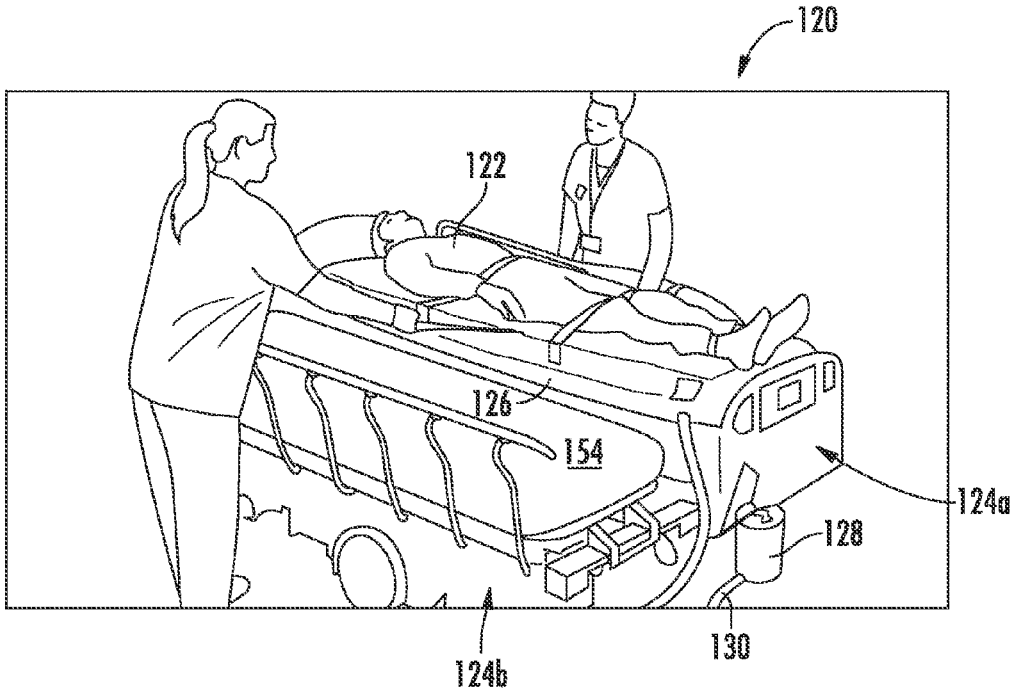
FIG. 9 is a perspective view of an air transfer system that may be used for facilitating the transfer of a patient from one patient support device to the another.

The patient lateral transfer system 120 according to one embodiment is depicted in FIG. 9. Patient lateral transfer system 120 is designed to facilitate movement of a patient 122 from a first patient support device 124*a* to a second patient support device 124*b*. In the embodiment illustrated in FIG. 9, the first patient support device 124*a* is a bed and the second patient support device 124*b* is a stretcher. It will be understood by those skilled in the art, however, that patient lateral transfer system 120 may be utilized with other types of patient support devices 124, including, but not limited to, cots, surgical tables, gurneys, chairs, and other patient support devices.

Patient lateral transfer system 120 includes an inflatable mat 126, a blower 128, and a hose 130 (FIG. 9). As was noted above, system 120 may be used with mat 12 or with mat 126, or with still other types of mats. Inflatable mat 126 includes a top surface 132 that is adapted to support patient 122 thereon. When it is time to transfer the patient from one patient support device 124 to another, inflatable mat 126 is inflated by way of blower 128. Inflatable mat 126 is then slid from the first patient support device 124*a* to the adjacent patient support device 124*b*. Thereafter, mat 126 may be deflated and removed from underneath the patient, either immediately after transfer, or after the passage of any suitable amount of time. Alternatively, mat 126 may be left deflated underneath the patient until it is desirable to transfer the patient to another surface.

Figure 10:
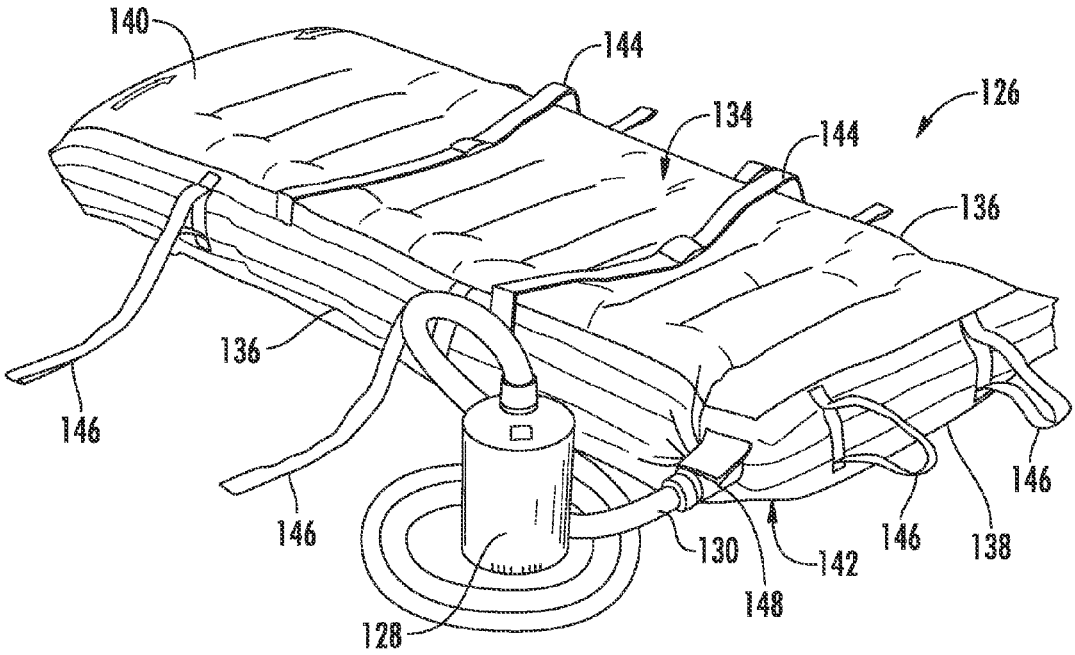
FIG. 10 is a perspective view of an inflatable mat and blower that may be used with the system of FIG. 9.

An illustrative manner of constructing mat 126 is depicted in greater detail in FIG. 10. As noted above, mat 126 includes a top surface 132 that is adapted to support the patient. As shown in FIG. 10, top surface 132 may be contoured to provide better comfort for the patient, although the type of contouring may vary widely. In other embodiments, top surface 132 may not provide any contouring at all. In the embodiment illustrated in FIG. 10, top surface 132 includes a raised perimeter 134 that extends around the edges of top surface 132.

In addition to top surface 132, inflatable mat 126 includes a pair of sides 136, a foot end 138, a head end 140, and a bottom surface 142. Inflatable mat 126 may further include, in some embodiments, one or more straps 144 for helping secure patient 122 to mat 126, as well as one or more hand holds 146 for allowing personnel to more easily grasp and manipulate mat 126. Mat 126 further includes an inlet port 148 adapted to couple to an end of hose 130 of blower 128 for receiving air.

Figure 11:
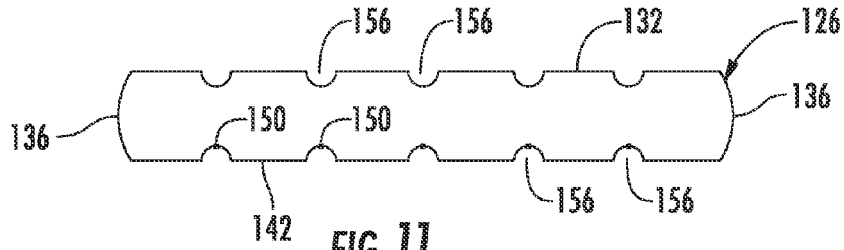
FIG. 11 is a sectional, elevational diagram of a representative inflatable mat that may be used in the system of FIG. 9.

A cross sectional diagram of an illustrative mat 126 taken along a path from one side 136 of mat 126 to another side 136 is illustrated in FIG. 11. The mat 126 illustrated in FIG. 11 is a simplified diagram representing the basic construction principles of mat 126. The particular shapes, sizes, and layout of the features of the mat 126 illustrated in FIG. 11 may vary from that shown, as will be discussed more below. As but one example, the mat 126 of FIG. 11 includes a generally flat top surface 132 that, as noted earlier, may be varied to include suitable contouring for providing better comfort to the patient and/or to provide a surface that a patient is more likely to stick to during transfer to another patient support device 124 (i.e. a surface on which a patient is less likely to slide upon during transfer).

Figure 12:
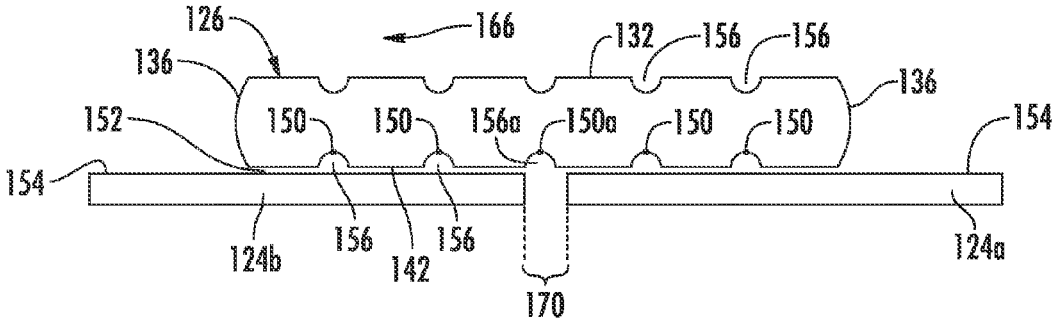
FIG. 12 is a sectional, elevational diagram of the representative inflatable mat of FIG. 11 along with a pair of support surfaces.

Bottom surface 142 of mat 126 includes a plurality of perforations 150. Perforations 150 are configured to allow a sufficient amount of air to escape from within mat 126 such that an air bearing 152 (FIG. 12) may be formed between bottom surface 142 and a top surface 154 of patient support device 124. In the embodiment illustrated in FIG. 12, both bottom surface 142 and top surface 132 of mat 126 include a plurality of indentations 156. Such indentations may be the result of baffles (not shown) defined in the interior of mat 126, or may be defined in other manners. The precise shape of the indentations shown in FIGS. 11 and 12 is not intended to be of significance, and these shapes may vary substantially.

In the bottom surface 142, the perforations 150 are defined adjacent the indentations 156. The size, shape, depth, surface tension/stiffness, airflow through, quantity, and location of both perforations 150 and indentations 156 can be varied from that illustrated in FIG. 11. The design and layout of perforations 150 and indentations 156 may affect the lifting performance and efficiency of mat 126 and can be implemented in a wide variety of different manners that provide satisfactory results. Several examples of the different configurations for mat 126 and its bottom surface 142 are disclosed in commonly assigned, copending U.S. application Ser. No. 11/801,007 filed May 8, 2007 by Thomas DeLuca et al, and entitled "AIR BEARING PALLET," the complete disclosure of which is hereby incorporated herein by reference. Other suitable mats that may be used with patient transfer system 120 are those manufactured by Stryker Corporation of Kalamazoo, Mich., the assignee of this application, under the model numbers 3061-500-028, 3061-500-032, and 3061-500-046, which are marketed under the Stryker Glide™ trademark.

When air is pumped into inflatable mat 126 from blower 128 via hose 130, a relatively small amount of air "leaks" through perforations 150 and generally fills in the spaces defined between indentations 156 and the top surface 154 of the patient support device 124 upon which the patient is supported. As the air pressure inside of mat 126 builds, the air pressure within these spaces also builds until the pressurized air eventually lifts the mat 126 upon air bearing 152 in a manner similar to conventional hovercrafts. As long as pressurized air continues to be supplied to mat 126 via blower 128, air bearing 152 will continue to lift mat 126 slightly off of the top surface 154 of patient support device 124. This lifting reduces the frictional forces between bottom surface 142 of mat 126 and top surface 154 of patient support device 124, thereby allowing mat 126 to slide laterally with respect to top surface 154 with little resistance. This reduced resistance enables health care personnel to more easily push and/or pull mat 126 from one patient support device 124 to another, thereby requiring less effort on the part of the health care personnel. Indeed, the use of mat 126 and the air bearing 152 upon which it rides may reduce the frictional resistance of sliding mat 126 to such an extent that the efforts of one or more health care personnel that would otherwise be necessary for patient transfer are no longer needed.

In the past, the use of inflatable mats 126 has involved a blower that runs continuously at a generally constant high speed during the initial inflation of mat 126 and the subsequent transfer of the patient from one surface 154 to another. This substantially continuous operation of the motor often results in the motor doing more work than is necessary for the patient transfer, thereby creating the unwanted side effects of excessive noise and unnecessary energy usage. In addition, the heat from the blower motor operating at a continuously high speed can heat the air inside of mat 126 to a level that is uncomfortable for the patient.

Patient transfer system 120 overcomes these difficulties by including a motor controller 158 (FIG. 13) that automatically controls the speed of a blower motor 164 in a manner that is more efficient, produces less noise, and which heats the pressurized air to a lesser degree than prior patient transfer systems. The motor controller 158 utilizes feedback from one or more sensors 160 that detect one or more quantities relating to inflatable mat 126. For example, in one embodiment, sensor 160 is an air flow sensor that detects the amount of air flowing into inflatable mat 126 from blower 128. In another embodiment, sensor 160 is an air pressure sensor that detects the air pressure inside of inflatable mat 126, or inside of hose 130 at a position that is in fluid communication with the inside of inflatable mat 126. In still other embodiments, both an air flow sensor 160 and an air pressure sensor 160 may be utilized together. In still other embodiments, a timer 162 may be utilized for carrying out the control of motor 164 of blower 128. In still other embodiments, additional sensors for sensing information useful to the control of blower 128 may also be utilized, in any suitable combination with one or more of the above-mentioned sensors 160.

As noted above, patient transfer system 120 includes blower 128, hose 130, and mat 126. In the embodiment illustrated in FIG. 13, blower 128 includes motor controller 158 that controls the speed and/or other characteristics of motor 164, such as, but not limited to, torque, the voltage supplied to motor 164, the current supplied to motor 164, and/or any combination of these characteristics. Motor 164 is positioned within an air channel or conduit 174 internal to blower 128 and includes the appropriate fan blades or other structures necessary to propel air from an inlet port 168 toward an outlet port 172 when the motor 164 runs. Outlet port 172 is adapted to be releasably coupled to hose 130, which, in the embodiment illustrated in FIG. 13, includes one or more sensors 160 positioned therein. It will be understood by those skilled in the art, of course, that the position of sensors 160 could be changed from that shown in FIG. 13, such as, but not limited to, positioning one or more of sensors 160 between, or adjacent to, the connection of outlet port 172 to hose 130, or positioning one or more of sensors 160 within blower 128 in a location in fluid communication with the portion of air channel 174 downstream of motor 164. Other locations are also possible. Motor 164 may be any suitable type of motor, whether DC, AC, frequency controlled, brushed or brushless, or other type of motor.

In general, motor controller 158 of patient transfer system 120 controls the motor 164 of blower 128 such that sufficient air pressure is maintained inside of mat 126 to keep it aloft via air bearing 152, but without creating excessive air pressure and excessive speeds of the motor 164. Stated alternatively, motor controller 158 controls motor 164 in such a way as to automatically adjust to the changing air needs of inflatable mat 126 during the patient transfer. The air needs of inflatable mat 126 dynamically change during the process of patient transfer for several reasons. For example, it is typically desirable to inflate mat 126 in a relatively short period of time, thereby reducing the time that the patient and health care personnel have to wait to begin the patient transfer process. As a result, it is often desirable to operate blower 128 at a relatively high speed so that mat 126 will be inflated relatively quickly. However, after mat 126 is inflated and is lifted onto air bearing 152, the consumption of air by inflatable mat 126 will typically drop as it no longer needs air for inflation, but rather only needs air for maintaining air bearing 152, which is typically less.

During movement of mat 126 in a lateral direction 166 (FIG. 12), the air needs of mat 126 may also change. These changes generally arise due to one or more of perforations 150 being shifted to a position in which fluid communication between the internal air inside mat 126 and the ambient air outside of mat 126 becomes more pronounced. In other words, the movement of mat 126 may result in one or more of the perforations 150 becoming substantially exposed to ambient air, thereby allowing a greater amount of air to escape through the perforations 150 than would otherwise happen if the perforation were merely supplying only the air necessary to maintain the air bearing 152. One example of such a situation is depicted in FIG. 12.

FIG. 12 is a side schematic view of an air mat 126 that is approximately midway through the process of being transferred from a first top surface 154 of a first patient support device 124*a* to a second top surface 154 of a second patient support device 124*b*. As can be seen therein, at least one indentation 156*a* and its corresponding perforation 150*a* are generally completely exposed to the surrounding, ambient air pressure. Stated alternatively, there is no air cushion supplied immediately adjacent perforation 150*a* and indentation 156*a*. This is because of a lateral gap 170 that exists between the two top surfaces 154 of the adjacent patient handling devices 124. The lateral gap 170 means that there is no surface immediately underneath perforation 150*a* and indentation 156*a* that would otherwise partially shield these two structures from the outside, ambient air. As a result, any perforations 150 that travel over lateral gap 170, such as perforation 150*a* in FIG. 12, will be exposed, at least temporarily, to the ambient air pressure within the room, which, due to blower 128, is substantially less than the air pressure inside of mat 126. As a result, the air inside of mat 126 will escape at a higher rate through the perforations 150 when they are positioned above lateral gap 170 than when they are positioned directly on top of one of surfaces 154. The passage of mat 126 over lateral gap 170 therefore results in a greater consumption of air by mat 126, at least to the extent it is desirable to maintain the same level of inflation in mat 126.

It is also possible for the air bearing 152 adjacent one or more particular indentations 156 to be disrupted by other causes besides the presence of lateral gap 170. One such cause may be the weight distribution of the patient, or a change in the weight distribution of the patient on mat 126. The particular weight distribution of the patient may cause portions of mat 126 to bend and/or twist in such a manner as to essentially expose one or more perforations 150 to ambient air pressure, thereby allowing a greater amount of air to escape than would otherwise. Such increased rates of air leakage result in greater air needs of inflatable mat 126. Still other causes may also lead to increased air needs for mat 126, such as roughness and/or discontinuities in one or both of top surfaces 154.

Patient lateral transfer system 120 is adapted to control blower 128 such that it increases its speed when more air is needed by mat 126 and decreases its speed when less air is required by mat 126. Motor controller 158 determines the air needs of mat 126 through one or more sensors 160, either alone or in combination with a timer 162. In one embodiment, motor controller 158 operates motor 164 at a relatively high rate of speed during the initial inflation of mat 126. After controller 158 determines that the mat 126 is completely inflated (in any of a variety of different manners that will be discussed below), controller 158 reduces the speed of mat 126 to a level sufficient to maintain the air cushion or air bearing 152. Thereafter, motor controller 158 monitors the air needs of mat 126 and increases the speed of motor 164 as necessary and decreases the speed of motor 164 when appropriate.

In one embodiment, patient lateral transfer system 120 utilizes only a single sensor 160 that detects air flow. In that embodiment, motor controller 158 initially operates motor 164 at a high rate of speed until mat 126 is inflated. Motor controller 158 detects that mat 126 is fully inflated when the air flow detected by sensor 160 drops. This drop is due to the initially large amounts of air flow that occur when mat 126 is being inflated followed by the smaller amount of air that, once the mat is inflated, escapes through perforations 150 to maintain the air bearing 152. In this embodiment, after motor controller 158 detects the drop in air flow and implements a corresponding drop in the speed of motor 164, motor controller 158 continues to monitor the output signals from sensor 160. When sensor 160 thereafter detects an increase in air flow, it is presumed that such an increase in air flow is due to increased air flowing out of inflatable mat 126, and that mat 126 therefore needs more air in order to maintain is current state of inflation, as well as its current air bearing 152. Motor controller 158 therefore sends the appropriate commands to motor 164 that cause the speed of motor 164 to increase, thereby supplying more air to mat 126. When motor controller 158 detects, via sensor 160, that the air flow rate has once again decreased back to the relatively low level associated with all of perforations 150 creating air bearings 152, motor controller 158 will reduce the speed of motor 164. In such an embodiment, motor controller 158 may therefore operate motor 164 at two distinct speeds: a relatively high speed and a relatively low speed, depending upon the sensed air flow. In other embodiments, motor controller 158 may be configured to operate motor 164 at more than two distinct speeds, such as, but not limited to, a low speed, a medium speed, and a high speed. Discrete speed levels beyond three are also possible. Indeed, in one embodiment, motor controller 158 may be implemented to operate motor 164 at generally continuously varying speeds, rather than a set of discrete speeds. In such embodiments, motor controller 158 may operate in such a manner that the speed of motor 164 tracks the air flow—that is, as the air flow into mat 126 increases, the speed of motor 164 is increased, and as the air flow into mat 126 decreases, the speed of motor 164 is decreased. The amount of the speed increase or decrease may be proportional to the change in air flow detected, or it may take on other relationships.

In other embodiments, patient lateral transfer system 120 may be implemented such that sensor 160 detects air pressure and system 120 utilizes no other feedback sensors other than air pressure sensor 160. In such embodiments, motor controller 158 may operate in a manner generally similar to those described above with respect to an air flow sensor. That is, motor controller 158 may initially drive motor 164 at a relatively high rate in order to inflate mat 126 and thereafter relax the speed of motor 164 (at least for a small amount of time) until a lower, threshold level of pressure is reached. Thereafter, motor controller 158 may control the speed of the motor 164 based upon the output of the air pressure sensor 160, with decreases in air pressure causing motor controller 158 to increase the speed of motor 164 and increases in air pressure causing motor controller 158 to decrease the speed of motor 164. Such increases and decreases in the speed of motor 164 may be carried out by switching the speed of motor 164 to one of a plurality of different discrete speeds, or they may be carried out by varying the speed of motor 164 in a generally continuous fashion. Motor controller 158 may automatically determine that inflatable mat 126 is fully inflated in any suitable manner, such as, but not limited to, detecting the passage of a preset amount of time, monitoring the air pressure inside the mat until a specific condition regarding the rate at which the air pressure inside mat 126 changes is met, monitoring the air pressure inside the mat until a specific air pressure value is attained, or any other suitable methods.

In still other embodiments, a timer 162 may feed a time signal into motor controller 158 that is used in conjunction with either an air pressure sensor 160 or an air flow sensor 160, or both. Motor controller 158 may carry out some or all of the control of motor 164 based either wholly or partially upon the outputs received from the timer 162, and the degree to which timer 162 influences the control of motor 164 may vary as well. As an example, one embodiment of patient transfer system 120 utilizes a timer 162 for determining when inflatable mat 126 has initially been inflated. That is, motor controller 158 operates motor 164 at a relatively high speed during the initial inflation of mat 126 for a predetermined amount of time. Thereafter, motor controller 158 may switch to utilizing only the output of sensor 160 (whether air pressure or air flow) in controlling motor 164. Alternatively, motor controller 158 may continue to utilize timer 162 in its control algorithms. Regardless of how motor 164 is used or not used after the inflation of mat 126, the predetermined time period may be set to a known amount of time that it takes for mat 126 to be inflated at the selected speed of motor 164, or it may be set to a slightly larger amount of time to accommodate for variations in inflation time that may occur due to temperature changes, mat size, patient weight, etc.

In still other embodiments, patient transfer system 120 may utilize two or more inputs into motor controller 158 that provide information that motor controller 158 uses in carrying out the control of motor 164. The two or more inputs may comprise two different sensors 160, such an air pressure sensor and an air flow sensor, or it may comprise multiple of the same types of sensors, such as two air flow sensors (which may be positioned physically at different locations). In still other alternatives, one of the multiple inputs into motor controller 158 may be timer 162, as well as one or more other sensors besides air pressure and air flow sensors. Such additional sensors might include temperature sensors, humidity sensors, or still other types of sensors.

In any of the various embodiments discussed herein, motor controller 158 may be configured to utilize closed-loop feedback principles that involve proportional control, proportional-integral-derivative (MD) control, or any combination or permutation of proportional, integral, and derivative factors. Additionally, the selected feedback control algorithm may be cascaded with additional algorithms. Still further, non-linear feedback control formats may also be used, either alone or in combination with linear systems. The control data that is fed back into motor controller 158 may take on any of the various forms described herein; that is, it may comprise air pressure data, air flow data, time, temperature, humidity, or any other data useful for controlling the speed of motor 164. The set point used in the feedback loop may correspond to any suitable parameter, such as air pressure, air flow rate, or other parameters, including combinations of these parameters. The set point may also be dynamic, depending upon the implementation of system 120.

Figure 13:
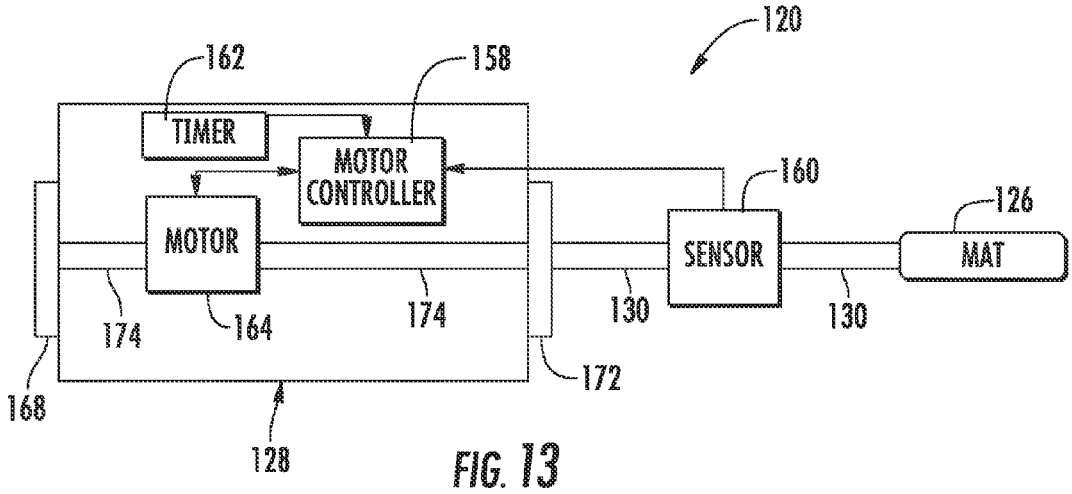
FIG. 13 is a schematic diagram of the patient lateral transfer system of FIG. 9.

The physical position of sensors 160 may be varied from that illustrated in FIG. 13. In some embodiments, one or more sensors 160 may be positioned in different locations along hose 130, or such sensors may be positioned inside mat 126, or they may be attached to the patient support device 124, such as on or adjacent top surface 154.

Inflatable mats 126 may be constructed of any suitable materials, such as would be known to one of ordinary skill in the art. In one embodiment, mat 126 may be made of nylon. Other materials may also be used, or other combinations of materials. The size of mat 126 may also vary in order to accommodate patients and/or surfaces of different size. In some embodiments, mat 126 may be adapted to support up to 1000 pounds or more. Depending upon the mat size, the control algorithms implemented by motor controller 158 may be altered. That is, in some embodiments, motor controller 158 may be configured to modify its control algorithms based upon the size of the air mat. As but one example, if motor controller 158 utilizes a timer 162 to determine when mat 126 is initially fully inflated, the amount of time that passes before motor controller 158 concludes that mat 126 is inflated may be varied based upon the size of mat 126. In other embodiments, if motor controller 158 is configured to maintain a threshold pressure within mat 126, or to maintain some other threshold parameter, these threshold may be varied depending upon mat size. The design of motor controller 158 will also naturally take into account the particular operating characteristics of the motor 164 itself.

In still other embodiments, blower 128 may be further modified to include one or more actuators (not shown) that adjust one or more mechanical structures in response to the changing air needs of inflatable mat 126. Such actuators may be adapted to move baffles or other mechanical structures positioned at the input port 168, the output port 172, or the internal conduit 174 within blower 128 wherein the physical movement of the structures changes a characteristic of the air flow in a known manner. Changes to these mechanical structures may be carried out in combination with the speed changes to motor 164 discussed above, or such changes may be made in lieu of speed changes to motor 164. The physical movement of such mechanical structures alters the air flow to mat 126 in a manner that adjusts to dynamically match the air needs of mat 126. As one example, blower 128 may include one or more physical structures within or adjacent air conduit 174, or within or adjacent outlet port 172, that selectively divert at least some air being blown by motor 164 to the ambient atmosphere. That is, instead of having all of the air blown by blower 128 into hose 130 (and consequently mat 126), a portion of this air may be selectively diverted to the ambient air. Such selective diversion may result in a reduced load being placed on motor 164, thereby reducing the energy consumed by motor 164. The decisions as to when this air should be diverted, as well as the amount, may be based upon the feedback signals from one or more of sensors 160 or timer 162, or any other suitable sensor or device. As noted above, such diversion of air may be the sole adjustment made to blower 128 in some embodiments, or it may be but one of several adjustments that blower 128 makes in response the feedback information supplied by sensors 160 and/or timer 162 and/or other sensors.

In any of the various embodiments discussed herein, motor controller 158 may be implemented with suitable electrical and/or electronic devices that are capable of carrying out the control algorithms described herein. Such electronic devices may include, but are not limited to, one or more microprocessors, integrated circuits, programmable logic devices, or any combination thereof. Blower 128 may also be replaced by an air pump, or other suitable device for supplying pressurized air to mat 126.

The foregoing embodiments of the invention are exemplary and can be varied in many ways and, further, features of one embodiment may be combined with features of another embodiment and used in combination with features of more than one embodiment. Such present or future variations are not to be regarded as a departure from the spirit and scope of the invention, and all such modifications are intended to be included within the scope of the following claims.

The disclosure of all patents, publications, including published patent applications, and database entries referenced in this specification are specifically incorporated by reference in their entirety to the same extent as if each such individual patent, publication, and database entry were specifically and individually indicated to be incorporated by reference.

We claim:

1. A patient transfer device comprising:

a mat, the mat having an upper side and a lower side, the upper side being adapted to limit the flow of fluid through at least a substantial portion of the upper side, and the lower side having a generally liquid impermeable, gas permeable portion;

the mat including a chamber between its upper and lower sides, the chamber being operable to be in fluid communication with an air source such that when air flows into the mat, the air will flow into the chamber and through the gas permeable portion of the lower side to form an air film between the mat and a surface on which the mat is supported at its lower side; and the lower side of the mat being substantially planar when the mat is inflated.

2. The patient transfer device according to claim 1, wherein the mat is configured so that the upper and lower sides remain substantially parallel even when the chamber is filled with air.

3. The patient transfer device according to claim 1, further comprising an intermediate layer, the chamber formed in the intermediate layer, the mat having a thickness measured from the upper side, through the intermediate layer, and to the lower side, the intermediate layer interconnecting the upper side to the lower side and providing a substantially continuous connection between the upper and lower sides wherein the thickness of the mat remains substantially uniform across its width and length when the inflated but unloaded with a patient.

4. The patient transfer device according to claim 1, wherein the mat has a thickness measured from through the upper side, the chamber, and the lower side, the thickness of the mat being less than 3" when the chamber is inflated but unloaded with a patient and the mat generates an air film at the lower side sufficient to transfer a patient.

5. The patient transfer device according to claim 1, wherein the chamber has volume of less than 6 cubic foot when the chamber is inflated and the mat generates an air film at the lower side sufficient to transfer a patient.

6. The patient transfer device according to claim 1, wherein the mat includes a gas and liquid impermeable barrier at the upper side to thereby form the upper side.

7. The patient transfer device according to claim 6, wherein the gas and liquid impermeable barrier is formed from a liquid and gas impermeable sheet.

8. The patient transfer device according to claim 1 wherein the generally liquid impermeable, gas permeable portion is liquid impermeable for liquids below 50 psi.

9. The patient transfer device according to claim 8, wherein the substantially liquid impermeable, gas permeable barrier is formed from a substantially liquid impermeable, gas permeable sheet, the substantially liquid impermeable, gas permeable sheet comprising: (a) a non-woven sheet with a plurality of perforations that are sized to permit gas to flow through the substantially liquid impermeable, gas permeable sheet but to limit the flow of a liquid therethrough or (b) a woven sheet with a plurality of interstices, the interstices being sized to permit gas to flow through the woven sheet but to limit the flow of a liquid therethrough.

10. The patient transfer device according to claim 1, further comprising an intermediate layer having upper and lower surfaces, the chamber formed in the intermediate layer, and the upper side of the mat is formed on the upper surface of the intermediate layer.

11. The patient transfer device according to claim 10, wherein the lower side is formed on the lower surface of the intermediate layer.

12. The patient transfer device according to claim 1, wherein the mat comprises an open cell foam, a three dimensional (3D) fabric, or a drop stitch fabric.

13. The patient transfer mat according to claim 1, further comprising at least one flange extending from the mat.

14. A patient transfer mat comprising:

an upper surface;

a liquid and gas permeable compressible layer; and a generally liquid impermeable, gas permeable barrier forming a lower surface of the mat, the liquid and gas permeable compressible layer providing a substantially continuous connection between the gas permeable barrier and the upper surface to form a substantially monolithic body, the liquid and gas permeable compressible layer forming a chamber which is adapted to be in fluid communication with a supply of air, wherein when inflated the air in the chamber flows though the gas permeable barrier to form an air film between the lower surface of the mat and a surface on which the mat is supported at its lower surface.

15. The patient transfer mat according to claim 14, wherein the compressible layer comprises an open cell foam, a three-dimensional (3D) fabric, or a drop stitch fabric.

16. The patient transfer mat according to claim 14, wherein the compressible layer has a substantially uniform thickness.

17. The patient transfer mat according to claim 14, further comprising at least one flange extending from the mat.

18. The patient transfer mat according to claim 17, wherein the flange has a sufficient lateral extent for inserting under a mattress or other support surface when the mat is positioned on a mattress or other support surface.

19. The patient transfer mat according to claim 17, wherein the flange is inflatable.

20. A method of making a patient transfer mat, the method comprising:

forming an upper side;

forming a generally liquid impermeable, gas permeable lower side;

forming a substantially continuous connection between the upper side and the lower side;

forming a chamber between the upper side and the lower side through the connection;

extending the connection across at least a portion of the width and length of the mat; and forming an inlet in fluid communication with the chamber for inflating the mat with a fluid.

21. A method of transferring a patient comprising:

providing a mat with an upper side, a generally liquid impermeable, gas permeable lower side, and a chamber therebetween;

placing the mat on a surface;

placing a patient on the mat;

directing gas into the chamber thereby inflating the mat and forming a gas film at the lower surface;

the inflating raising the patient no more than 1 inch above the surface; and pulling on the mat to thereby move the patient from the surface onto another surface.

* * * * *